US005634808A

United States Patent [19]

Shinji

[11] Patent Number: 5,634,808

[45] Date of Patent: Jun. 3, 1997

[54] WATERPROOF PACKING FOR CONNECTORS

[75] Inventor: Yasuhisa Shinji, Shizuoka, Japan

[73] Assignee: Yazaki Corporation, Tokyo, Japan

[21] Appl. No.: 521,573

[22] Filed: Aug. 30, 1995

[30] Foreign Application Priority Data

Aug. 30, 1994 [JP] Japan ..... 6-205407

[51] Int. Cl.[6] ..... H01R 13/52

[52] U.S. Cl. ..... 439/277; 439/271

[58] Field of Search ..... 439/271, 277, 439/274, 275, 598

[56] References Cited

U.S. PATENT DOCUMENTS

| | | | |
|---|---|---|---|
| 2,619,515 | 11/1952 | Doane | 439/274 |
| 3,920,304 | 11/1975 | Bromberg | 439/274 |
| 4,173,385 | 11/1979 | Fenn et al. | 439/277 |
| 4,421,373 | 12/1983 | Ratchford et al. | 439/277 |
| 4,556,271 | 12/1985 | Hubbard | 439/277 |
| 4,580,865 | 4/1986 | Fryberger | 439/277 |
| 4,614,390 | 9/1986 | Baker | 439/275 |
| 4,698,027 | 10/1987 | Vandame | 439/271 |
| 4,707,047 | 11/1987 | Michaels et al. | 439/277 |
| 5,112,241 | 5/1992 | Chesnut et al. | 439/274 |
| 5,277,610 | 1/1994 | Krehbiel et al. | 439/271 |

*Primary Examiner*—Neil Abrams
*Assistant Examiner*—Brian J. Biggi
*Attorney, Agent, or Firm*—Sughrue, Mion, Zinn, Macpeak & Seas

[57] ABSTRACT

A waterproof packing is axially compressed between a pair of female and male connectors in intimate contact therewith to form a liquid-tight seal between the two connectors. An axial thickness T1 of a radially outward portion of a compression portion of the packing which can be compressed between the two connectors is smaller than a thickness T2 of a radially inward portion thereof. With this construction, the radially-outward bulging or deformation, caused by the axial compressive deformation, proceeds progressively from the radially inward portion, so that the radially-outward bulging or deformation can be suppressed to a low level.

4 Claims, 4 Drawing Sheets

WATERPROOF PACKING FOR CONNECTORS

BACKGROUND OF THE INVENTION

1. Field of the Invention

This invention relates to a pair of male and female connectors fitted together to make an electrical connection therebetween, and more particularly to a waterproof packing axially compressed by the male and female connectors to form a liquid-tight seal between the two connectors.

2. Related Art

There have heretofore been used various connectors for electrically connecting a plurality of wires together, and one such connector has a waterproof construction for preventing rain water or the like from intruding into metal terminals fitted together.

For example, as shown in FIG. 4, a tubular collar 20 is fitted on a female connector 10 for angular movement about an axis thereof. Internal threads 21 formed in the inner surface of the collar 20 are threadedly engaged with external threads 32 formed on a fitting portion 31 of a male connector 30 shown in FIG. 5, so that the female and male connectors are threadedly connected together. As a result, male terminals 34 provided on the male connector 30 are fitted respectively into female terminals (not shown) provided on the female connector 10.

An annular packing 90 of a generally U-shaped cross-section is fitted on a disk-shaped flange 11, formed integrally on the female connector 10, to surround an outer peripheral edge portion of the flange 11.

As shown in FIG. 6, the packing 90 of a generally U-shaped cross-section includes a portion 91 for intimate contact with a surface 33 of the male connector 30 facing the flange 11, an axial wall portion 92 disposed radially outwardly of the flange 11, and a retaining portion 93 for retaining the two portions 91 and 92 on the flange 11.

When the female and male connectors 10 and 30 are threadedly connected together through the collar 20, the portion 91 of the packing 90 for intimate contact with the surface 33 is axially compressed between the flange 11 and the surface 33 of the male connector 30, and is held in intimate contact with them. As a result, there is formed a liquid-tight seal which prevents rain water or the like from intruding into the metal terminals provided at central portions of the female and male connectors 10 and 30.

In the above waterproof packing 90, however, a thickness T of the compression portion 91 axially compressed between the flange 11 and the surface 33 of the male connector 30 is uniform. Therefore, when the female connector 10 is threadedly connected to the male connector 30, the compression portion 91 of the packing 90 is axially compressed between the female and male connectors 10 and 30 to bulge radially outwardly into contact with the internal threads 21 formed on the inner surface of the collar 20. Therefore, the collar 20 is rotated, with the waterproof packing 90 held in contact with the internal threads 21, which invites problems that the outer peripheral surface of the packing 90 is damaged and that the packing 90 is caught between the internal threads 21 and the external threads 32, and is damaged.

Further, when the waterproof packing 90 is held in contact with the internal threads 21, the compression portion 91 is deformed, which leads to a possibility that the seal between the female and male connectors 10 and 30 is incomplete.

It may be proposed to increase the outer diameter of the collar 20 in order that the waterproof packing 90 will not be brought into contact with the internal threads 21. In this case, however, the mounting space must be increased, and the size of the connectors is increased, thus inviting a problem that the manufacturing cost and the weight are increased.

SUMMARY OF THE INVENTION

The present invention has been made in view of the above problems, and an object of the invention is to provide a waterproof packing which, when compressed axially between female and male connectors, will not easily bulge radially outwardly.

The above object of the invention has been achieved by a waterproof packing for connectors wherein the pair of female and male connectors are fitted together inside of a tubular internally-threaded member; the waterproof packing has a generally U-shaped cross-section, and can be fitted on a flange, formed on one of the two connectors in coaxial relation to the internally-threaded member, to surround an outer peripheral portion of the flange; and when the two connectors are fitted together, the packing can be axially compressed between the two connectors in intimate contact with the two connectors, thereby forming a liquid-tight seal between the two connectors; wherein thickness-reducing means is provided on a compression portion of the waterproof packing which can be compressed between the two connectors, so that a thickness of a radially outward portion of the compression portion in the axial direction is smaller than a thickness of a radially inward portion of the compression portion in the axial direction.

The above object has been achieved by a construction in which the thickness-reducing means is formed by that surface of the compression portion which can face the other connector, and is slanting in such a manner that the slanting surface approaches the flange progressively radially outwardly.

The above object has been achieved by a construction in which the thickness-reducing means is formed by a pair of first and second ribs which are formed at least on one of that surface of the compression portion for intimate contact with the other connector and that surface of the compression portion for intimate contact with the flange; the ribs extends in a direction of a circumference of the packing; and the first rib is disposed at a radially inward portion of the compression portion, and has a larger cross-sectional area whereas the second rib is disposed at a radially outward portion of the compression portion, and has a smaller cross-sectional area.

In the waterproof packing of the invention for the connectors, the slanting surface is formed on the compression portion axially compressed between the pair of female and male connectors in such a manner that the axial thickness of the radially outward portion of the compression portion is smaller than the axial thickness of the radially inward portion of the compression portion. Therefore, the axial compressive deformation by the pair of female and male connectors first begins at the radially inward portion, and gradually spreads toward the radially outward portion. As a result, the radially—outward bulging or deformation of the waterproof packing, caused in accordance with the axial compressive deformation, proceeds progressively from the radially inward portion toward the radially outward portion, so that the waterproof packing is prevented from being bulged outwardly of the outer peripheral surface of the waterproof packing.

The thickness-reducing means is formed by the first and second ribs which are formed at least on one of that surface of the compression portion for intimate contact with the other connector and that surface of the compression portion for intimate contact with the flange, and the ribs extends in the direction of the circumference of the packing, and the first rib is disposed at the radially inward portion of the compression portion, and has a larger cross-sectional area whereas the second rib is disposed at the radially outward portion of the compression portion, and has a smaller cross-sectional area. Therefore, the radially inwardly-disposed first rib is first compressed, and then the radially outwardly-disposed second rib is compressed. As a result, the radially-outward bulging or deformation of the waterproof packing, caused in accordance with the axial compressive deformation, proceeds progressively from the radially inward portion, so that the radially-outward bulging or deformation of the whole of the compression portion can be suppressed.

Therefore, even when the waterproof packing is axially compressed between the female and male connectors, the radially-outward bulging or deformation can be suppressed to a low level, so that the waterproof packing will not be damaged by contact with internal threads of the internally-threaded member, or will not be caught and damaged by the internal threads.

DETAILED DESCRIPTION OF THE PREFERRED EMBODIMENTS

Figure 1:
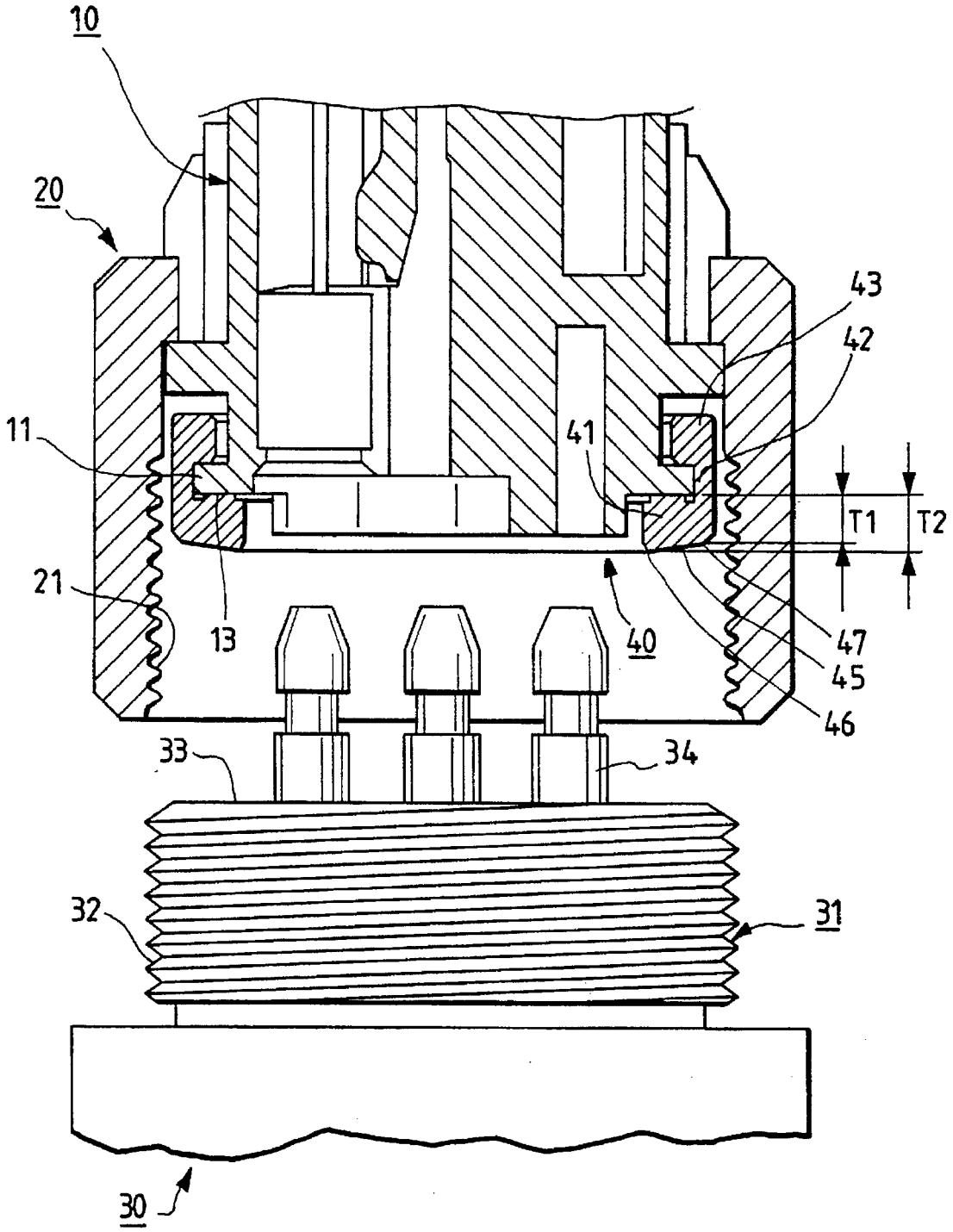
FIG. 1 is a cross-sectional view showing a first embodiment of a waterproof packing of the invention for connectors.
Figure 2:
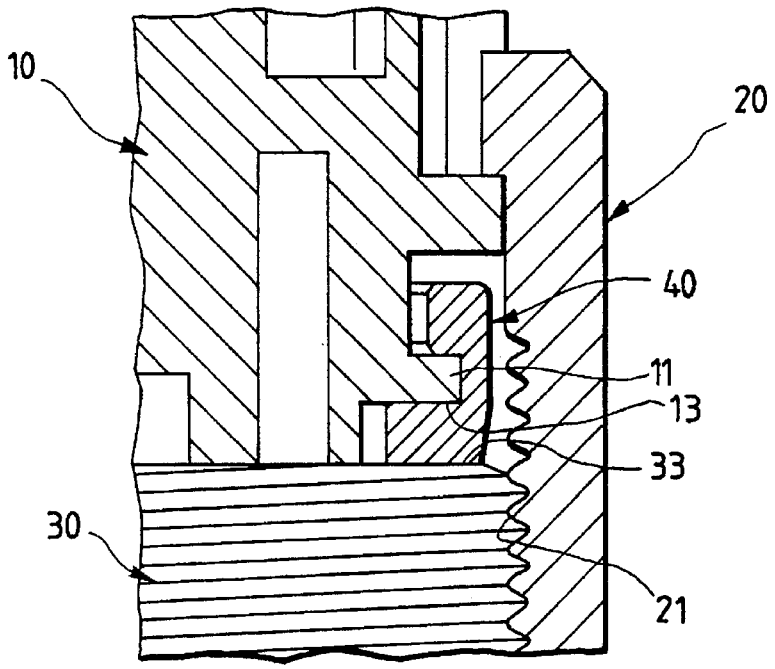
FIG. 2 is an enlarged, cross-sectional view showing the waterproof packing of FIG. 1 in a condition in which female and male connectors are fitted together.

A first embodiment of a waterproof packing of the present invention for connectors will now be described with reference to FIGS. 1 and 2. FIG. 1 is a cross-sectional view showing the first embodiment of the waterproof packing of the invention for the connectors, and FIG. 2 is an enlarged, cross-sectional view showing female and male connectors fitted together. Those portions identical to those of the connectors of the above conventional construction will be designated by the same reference numerals, respectively, and detailed description thereof will be omitted.

As shown in FIG. 1, the waterproof packing 40 includes a compression portion 41 adapted to be axially compressed between a flange 11 of the female connector 10 and the male connector 30, an axial wall portion 42 disposed in contiguous relation to an outer peripheral edge of the flange 11, and a retaining portion 43 disposed in contiguous relation to a rear surface of the flange 11. The waterproof packing 40 is molded into an annular configuration having a generally U-shaped cross-section, and this packing 40 is fitted on the disk-shaped flange 11 to surround the outer peripheral edge portion thereof.

A slanting surface, serving as thickness-reducing means, is formed on that surface 45 of the compression portion 41 facing the male connector 30, and this slanting surface is approaching the flange 11 progressively radially outwardly. Namely, a thickness T1 of the radially outward portion of the compression portion 41 in the axial direction is smaller than a thickness T2 of the radially inward portion thereof in the axial direction.

With this construction, as the female connector 10 is threadedly connected to the male connector 30, with the distance therebetween gradually decreased, the compression portion 41 of the waterproof packing 40 is gradually compressed and deformed axially between the female and male connectors 10 and 30. This compressive deformation occurs first at a radially innermost portion 46. Then, as the distance between the female and male connectors 10 and 30 is decreasing, the compressive deformation gradually spreads toward the radially outward portion, and finally a radially outermost portion 47 is compressively deformed.

Therefore, the radially-outward bulging or deformation, developing as the compression portion 41 of the waterproof packing 40 is compressively deformed axially, begins at the radially innermost portion 46, and proceeds progressively toward the radially outward portion.

Namely, the radially outwardly-spreading bulging or deformation in accordance with the axial compressive deformation of the compression portion 41 of the waterproof packing 40 is suppressed to a smaller degree as compared with the conventional packing in which the compression portion has a uniform axial thickness.

Thus, even when the waterproof packing 40 of this embodiment is compressively deformed axially between the female and male connectors 10 and 30, the degree of the radially-outward bulging or deformation is kept small as shown in FIG. 2, and therefore the packing will not be damaged or deformed by contact with the internal threads 21 on the collar 20, so that the seal between the female and male connectors 10 and 30 will not be affected.

The waterproof packing 40 of this embodiment has the same outer diameter as that of the conventional waterproof packing 90, and therefore it is not necessary to increase the outer diameter of the collar 20. Therefore, the space required for installing the connectors is not increased, and also the manufacturing cost is not increased.

Next, a second embodiment of a waterproof packing for connectors will now be described with reference to FIG. 3.

Figure 3:
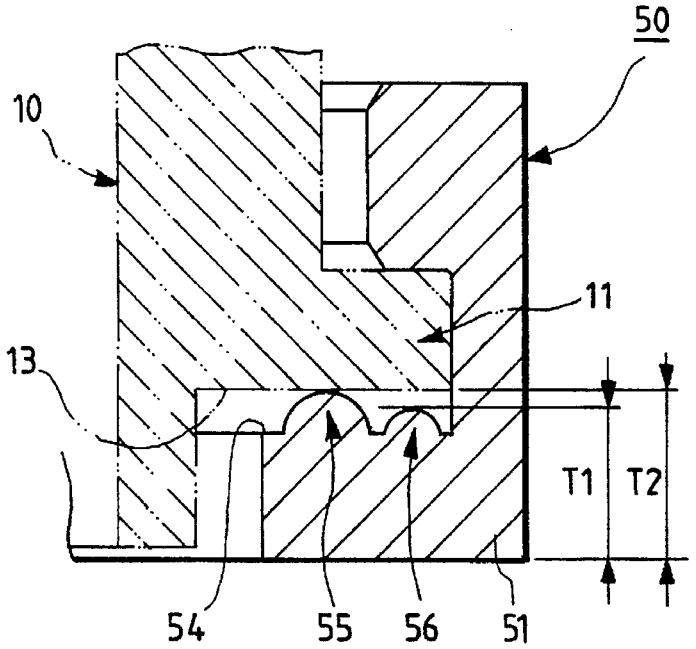
FIG. 3 is an enlarged, cross-sectional view showing a second embodiment of a waterproof packing of the invention for connectors.
Figure 4:
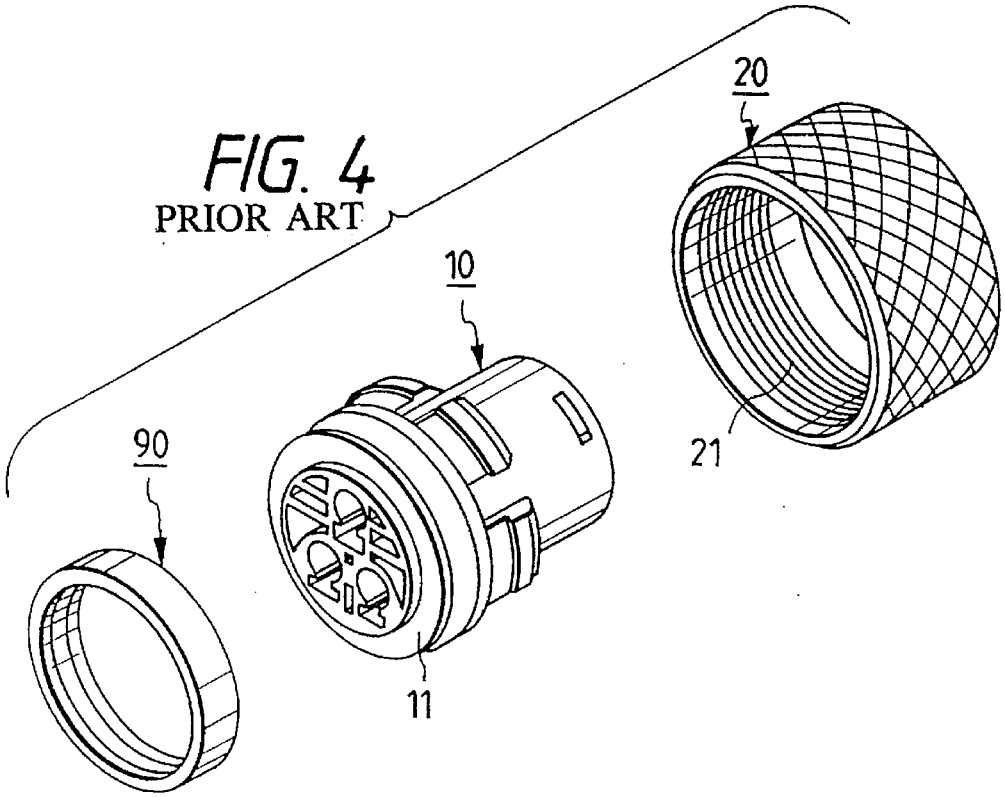
FIG. 4 PRIOR ART
FIG. 4 is an exploded, perspective view of a conventional female connector.
Figure 5:
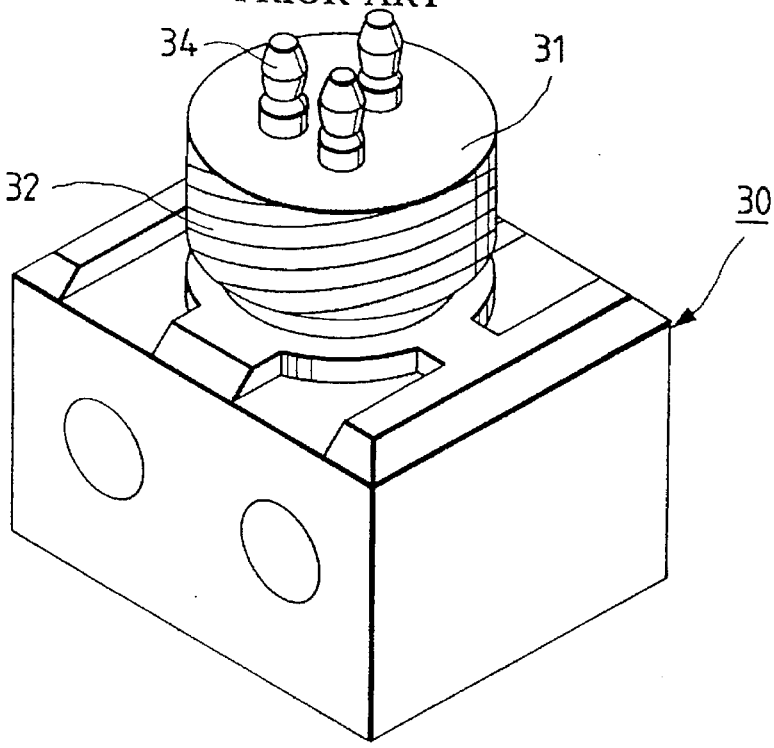
FIG. 5 PRIOR ART
FIG. 5 is a perspective view of a conventional male connector.
Figure 6:
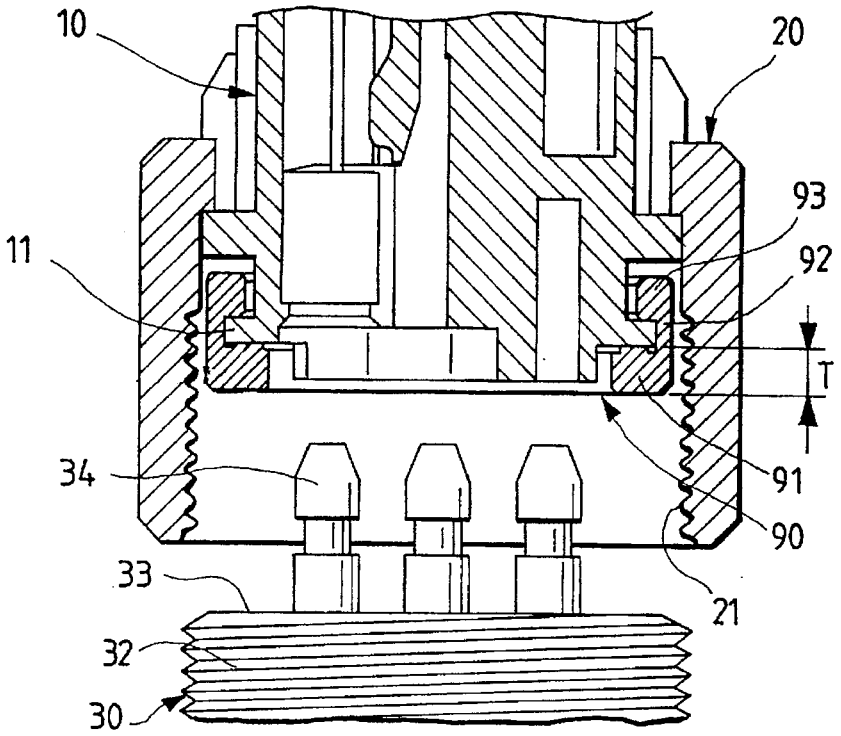
FIG. 6 PRIOR ART
FIG. 6 is a cross-sectional view showing a waterproof packing of FIG. 4 in a condition before the female and male connectors are fitted together.
Figure 7:
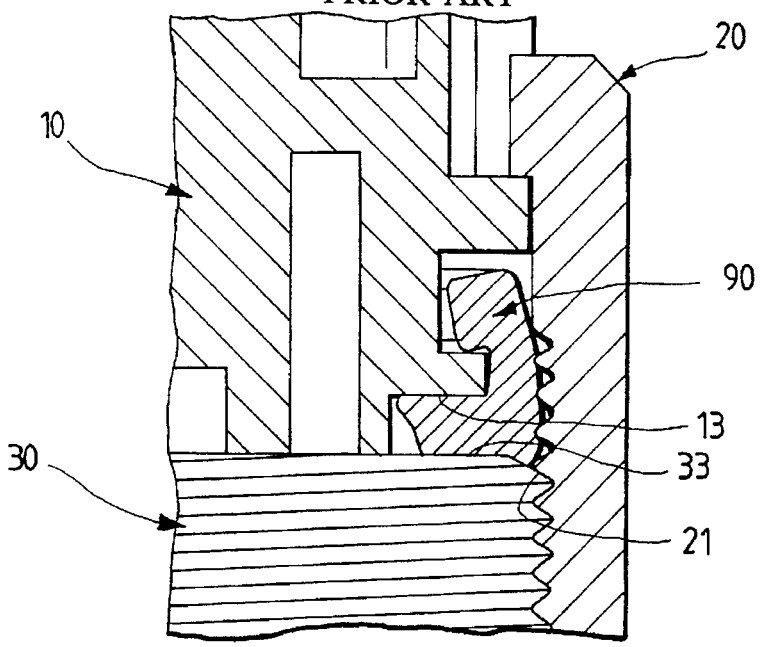
FIG. 7 PRIOR ART
FIG. 7 is an enlarged, cross-sectional view showing the waterproof packing of FIG. 4 in a condition in which the female and male connectors are fitted together.

As shown in FIG. 3, this waterproof packing 50 has a portion 51 to be compressed between the female and male connectors 10 and 30, and a pair of annular ribs 55 and 56 (which serve as thickness-reducing means) each having a semi-circular cross-section are formed on that surface 54 of the compression portion 51, facing the flange 11 of the female connector 10, over an entire circumference thereof. The radially inwardly-disposed first rib 55 is greater in cross-sectional area than the radially outwardly-disposed second rib 56.

Thus, the cross-sectional area of the first rib 55 is larger than that of the second rib 56, and a thickness T2 of the first rib 55 of the compression portion 51 in the axial direction is larger than a thickness T1 of the second rib 56 in the axial direction. Therefore, as the waterproof packing 50 is axially compressed in accordance with the fitting of the female connector 10 into the male connector 30, the first rib 55 is first brought into contact with a packing contact surface 13 of the flange 11.

Therefore, in accordance with the fitting of the female connector 10 into the male connector 30, an upper end portion of the radially inwardly-disposed first rib 55 of the compression portion 51 of the waterproof packing 50 of this embodiment is first compressed, and then an upper end portion of the radially outwardly-disposed second rib 56 is compressed.

Thus, the radially-outward bulging or deformation, caused by the axial compression of the compression portion 51 of the waterproof packing 50, proceeds sequentially from the radially inward portion toward the radially outward portion. Therefore, in cooperation with the effect achieved by the fact that the thickness T1 of the second rib 56 is smaller than the thickness T2 of the first rib 55, this suppresses the radially-outward bulging or deformation of the whole of the compression portion 51 to a low level.

Therefore, the waterproof packing 50 of this embodiment will not be damaged or deformed by contact with the internal threads 21 of the collar 20, and therefore the seal between the female connector 10 and the female connector 30 will not be affected.

The waterproof packing 50 of this embodiment has the same outer diameter as that of the conventional waterproof packing 90, and therefore it is not necessary to increase the outer diameter of the collar 20. Therefore, the space required for installing the connectors is not increased, and also the manufacturing cost is not increased.

In the second embodiment, although the first and second ribs 55 and 56 are formed on the surface 54 of the waterproof packing 50 facing the flange 11 of the female connector 10, such ribs may be formed on that surface of the compression portion 51 facing the male connector 30. The cross-sectional shape and the number of the ribs can be suitably changed.

As described above, in the waterproof packing of the invention for the connectors, the thickness-reducing means is provided on the compression portion of the waterproof packing which can be compressed between the pair of female and male connectors, so that the thickness of the radially outward portion of the compression portion in the axial direction is smaller than the thickness of the radially inward portion of the compression portion in the axial direction.

With this construction, the radially-outward bulging or deformation of the compression portion which can be axially compressed between the female and male connectors can be suppressed to a low level. Therefore, the waterproof packing is prevented from being damaged by contact with the internal threads of the internally-threaded member or from being caught by the internal threads, and the seal, formed by the waterproof packing between the female and male connectors, can be positively secured.

And besides, the waterproof packing of the invention has the same outer diameter as that of the conventional waterproof packing, and therefore it is not necessary to increase the outer diameter of the internally-threaded member. Therefore, the space required for installing the connectors is not increased, and also the manufacturing cost is not increased.

What is claimed is:

1. A waterproof connector comprising:

a pair of female and male connectors fitted together inside of a tubular internally-threaded member;

a waterproof packing having a generally U-shaped cross-section, said waterproof packing being fitted on a flange formed on one of said two connectors in coaxial relation to said internally-threaded member to surround an outer peripheral portion of said flange, wherein when said two connectors are fitted together, said packing can be axially compressed between said flange of said one connector and said other connector, thereby forming a liquid-tight seal between said two connectors; and thickness-reducing means, provided on a compression portion of said waterproof packing defined by a portion of said packing compressed between said flange and said other connector, for reducing an axial thickness of a radially outward portion of said compression portion in an axial direction of said packing relative to the axial thickness of a radially inward portion of said compression portion in said axial direction, wherein said thickness-reducing means is formed in such a manner that said axial thickness of said compressed portion is gradually reduced from said radially inward portion to said radially outward portion.

2. A waterproof packing of claim 1, wherein a surface of said compressed portion facing said other connector is inclined.

3. A waterproof connector comprising:

a pair of female and male connectors fitted together inside of a tubular internally-threaded member;

a waterproof packing having a generally U-shaped cross-section, said waterproof packing being fitted on a flange formed on one of said two connectors in coaxial relation to said internally-threaded member to surround an outer peripheral portion of said flange, wherein when said two connectors are fitted together, said packing can be axially compressed between said flange of said one connector and said other connector, thereby forming a liquid-tight seal between said two connectors; and thickness-reducing means, provided on a compression portion of said waterproof packing defined by a portion of said packing compressed between said flange and said other connector, for reducing an axial thickness of a radially outward portion of said compression portion in an axial direction of said packing relative to the axial thickness of a radially inward portion of said compression portion in said axial direction, wherein said thickness-reducing means is formed by a pair of first and second ribs which are formed at least on one of a surface of said compression portion which contacts the other connector and an opposite surface of said compression portion which contacts said flange, and said ribs extends in a direction of a circumference of said packing.

4. A waterproof packing for connectors according to claim 3, said first rib is disposed at a radially inward portion of said compression portion, said second rib is disposed at a radially outward portion of said compression portion, and said second rib has a cross-sectional area which is smaller than that of said first rib.

* * * * *